US006026601A

United States Patent [19]

Kiel

[11] Patent Number: 6,026,601

[45] Date of Patent: Feb. 22, 2000

[54] IRONING BOARD ADAPTED TO VERTICAL SURFACE

[76] Inventor: Walter J. Kiel, 8402 Rosewood Ave., Cleveland, Ohio 44105

[21] Appl. No.: 09/317,822

[22] Filed: May 25, 1999

[51] Int. Cl.[7] ..... D06F 81/06; A47B 5/04

[52] U.S. Cl. ..... 38/137; 108/47

[58] Field of Search ..... 38/137, 139, 103, 38/104, 106, DIG. 1, DIG. 2, DIG. 3; 108/47, 48; 223/54, DIG. 2

[56] References Cited

U.S. PATENT DOCUMENTS

| | | | |
|---|---|---|---|
| D. 306,508 | 3/1990 | Stringer . | |
| D. 369,889 | 5/1996 | Buckner . | |
| 596,427 | 12/1897 | Richey | 38/DIG. 2 |
| 1,257,114 | 2/1918 | Potter et al. | 38/137 X |
| 1,534,095 | 4/1925 | Walker | 108/48 |
| 1,859,719 | 5/1932 | Shrage | 108/48 |
| 3,050,355 | 8/1962 | Hess et al. | 108/48 |
| 3,242,882 | 3/1966 | Hoyt | 108/48 |
| 3,636,892 | 1/1972 | Linton | 108/48 |
| 4,799,321 | 1/1989 | Johnson . | |
| 4,862,611 | 9/1989 | Wright . | |
| 4,961,388 | 10/1990 | Simpson | 108/48 X |
| 5,036,777 | 8/1991 | Barton . | |
| 5,329,860 | 7/1994 | Mattesky | 108/48 |
| 5,706,593 | 1/1998 | Allard et al. . | |

*Primary Examiner*—Ismael Izaguirre
*Attorney, Agent, or Firm*—Donald A. Bergquist

[57] ABSTRACT

An ironing table is provided having a pivoting clamp that clamps to a vertical panel and also having a braced leg pivoted at an adjustable angle depending from the underside of the ironing table to provide adjustable support for the table, resulting in a cantilever-type support for the same. The clamp, leg, and brace pivot to closely hug the underside of the table when it is in a storage position. An optional hook pivotably mounted to the table allows for hanging storage as from a closet pole.

5 Claims, 4 Drawing Sheets

IRONING BOARD ADAPTED TO VERTICAL SURFACE

BACKGROUND OF THE INVENTION

1. Field of the Invention

This invention relates to ironing tables. Specifically, the ironing table of this invention is one wherein the supports are adapted to cantilever the ironing surface on a substantially vertical panel, such as the back of a chair or on one of a bank of drawers, which may be a part of a built-in cabinet or a bureau or chest of drawers. The supports are collapsible to hug the underside of the table for storage and an optional hook is provided for hanging the table from a support, such as a rod in a closet.

2. Description of the Prior Art

Ironing tables for use with a flat iron have been in use for many years for smoothing textiles. Residential use of flat irons and ironing tables has declined in recent years because of the development of so-called "permanent press" fabrics and "wrinkle-free" fabrics; such fabrics are used in various garments types that in the past required smoothing as by ironing or pressing. Indeed, one could surely find many young adults now who are ill-versed in the domestic skills and who could not or would not make extensive use of an ironing table. Even these "domestically challenged" may still have a need, however, for an occasional "touch up" ironing of their garments, table linens, or other wrinkle-prone articles.

Many homes and especially apartments and trailer homes or homes of modular construction have storage space limitations or work space limitations that preclude the keeping and the use of ironing tables that would be considered "full size."

To be sure, other inventors have addressed this problem. Their efforts, however, appear to have not resulted in the product I believe is optimal for its varied applications.

In U.S. Pat. No. 5,706,593, issued to Allard et al. in 1998, an ironing table (or "ironing board", in the terminology of Allard et al.) is presented that has a plurality of short legs or pegs that extend downwardly from the rear portion of the board, with the rear set being positionally fixed relative to the board and the front set being adjustably affixed to the board to adjust the spacing between the front and rear sets of pegs, thereby to fit closely about a generally horizontal ledge or edge, such as a window sill, counter top edge, etc., to secure the rear portion of the board. The adjustment method illustrated in the patent allows a user to adjust the position of the front set of pegs and to lock them in place before setting the rear portion of the board on its supporting surface. This adjustment allows fitting the pegs to the width of the horizontal ledge, but is not construed as any clamping means, for when the pegs embrace the ledge, they are not in any position for easy adjustment to press or clamp upon the ledge.

The board of Allard et al. has also a single telescoping leg on the forward portion of the board and is extended to a suitable length and braced in "some manner." The manner taught by Allard et al. is that this leg extends downward from the board and is braced by the juncture of the floor and a vertical surface extending from the ledge upon which the board rests. No example or description of other bracing is provided nor is suggested.

SUMMARY OF THE INVENTION

It is an object of this invention to provide an ironing table comprising a flat, thin, planar table portion having a forward end, an opposite substantially straight rearward end, and a midpoint, an upper surface, and an opposite lower surface, and having attached to said lower surface a screw clamp means pivotably attached along an axis that is proximal to said rearward end and substantially parallel thereto, said clamp adapting said ironing table for attachment to a panel that is substantially vertical; a leg pivotably attached along an axis that is substantially parallel to said rearward end, thereby to pivot through an angle of nearly 180 degrees to contact a fixed surface that is fixed relative to said panel; wherein said screw clamp means in combination with said leg provides support for said ironing table while in use.

It is another object of this invention to provide a hook means for hanging such an ironing board from a support such as a closet pole.

A simpler object of this invention is to provide an ironing table comprising a flat, thin, planar table portion having a forward end, an opposite substantially straight rearward end, and a midpoint, an upper surface, and an opposite lower surface, and having attached to said lower surface: a screw clamp means pivotably attached along an axis that is proximal to said rearward end and substantially parallel thereto, said clamp adapting said ironing table for attachment to a panel that is substantially vertical; a leg pivotably attached along an axis that is substantially parallel to said rearward end, thereby to pivot through an angle of nearly 180 degrees to contact a fixed surface that is fixed relative to said panel; wherein said screw clamp means in combination with said leg provides support for said ironing table while in use.

BRIEF DESCRIPTION OF THE DRAWINGS

This invention will be most easily understood by referring to the figures attached hereto, wherein.

DETAILED DESCRIPTION OF THE PREFERRED EMBODIMENTS

The various figures attached hereto are useful in describing this invention. In these figures, the same part is identified throughout by the use of a unique reference number.

Figure 1:
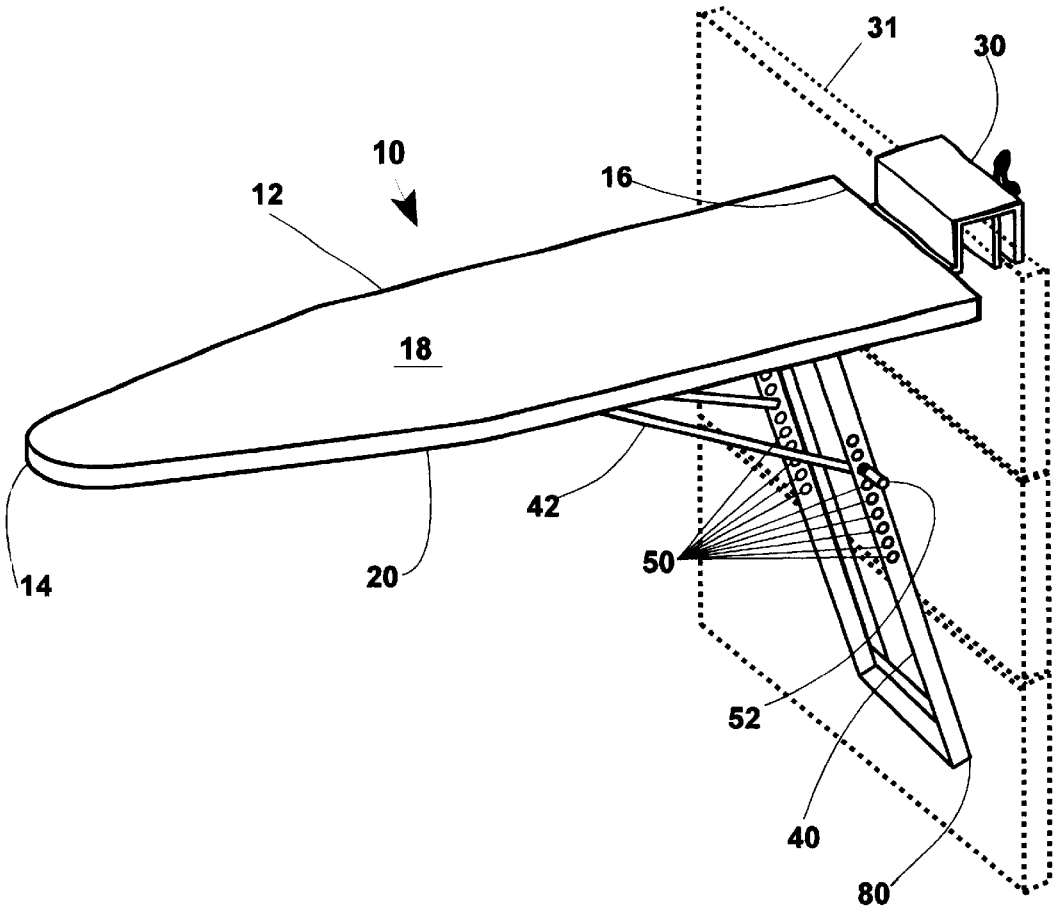
FIG. 1 is a perspective drawing showing how the ironing table of this invention may be supported on a set of drawers.
Figure 4:
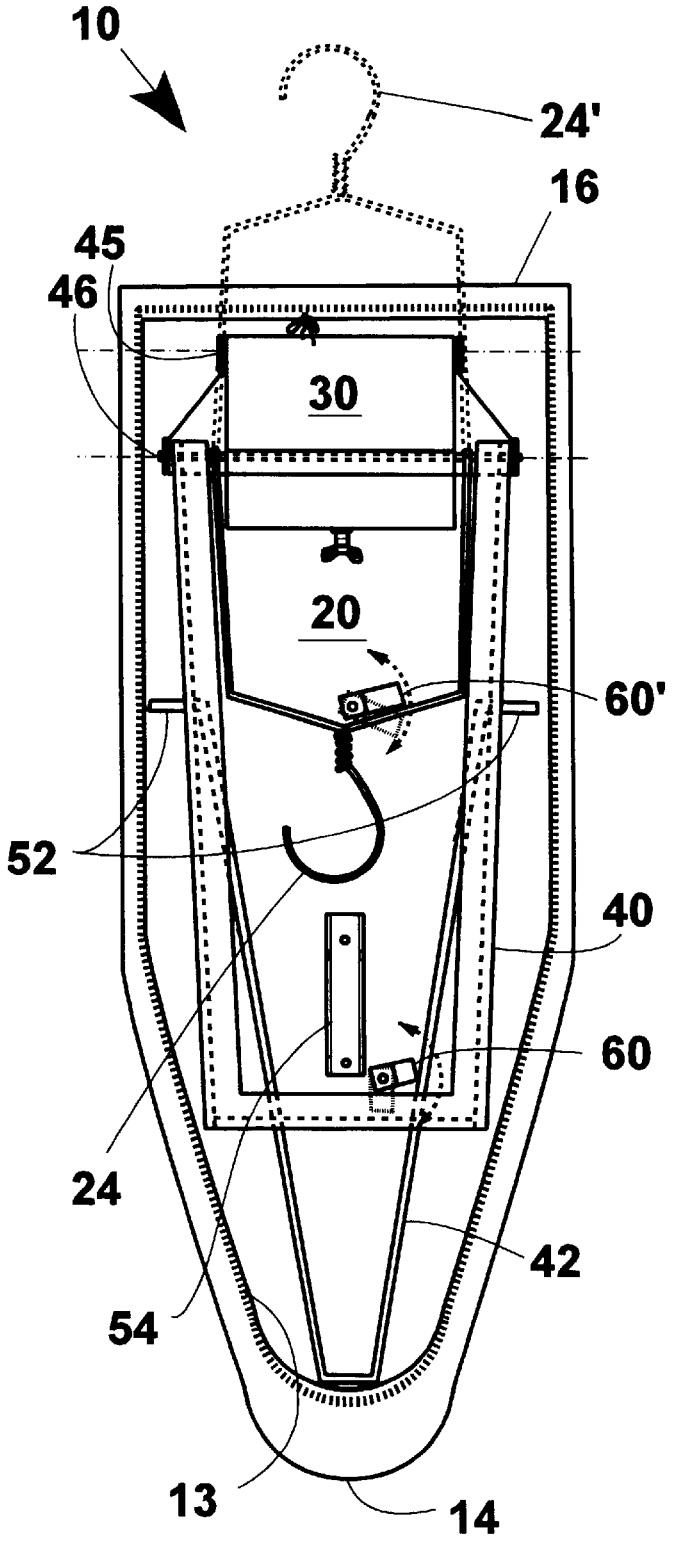
FIG. 4 is a bottom view of the ironing table of this invention, collapsed as for storage.

The readers attention is drawn to FIG. 1. The table 10 includes a flat, thin, planar table portion 12 having a forward end 14, an opposite rearward end 16, an upper or top surface 18, and an opposite lower or bottom surface 20. The table portion 12 may be formed of any of a number of suitable materials such as wood, sheet metal, expanded sheet metal, or even a rigid plastic material that is resistant to high temperatures. As is common practice in using ironing tables, the present ironing table 10 is preferably used with an ironing table pad and cover, the periphery 13 of which is shown in FIG. 4 beneath the edge of the table portion 12. The use of a cover and particularly a pad and cover, will reduce the effects of heat from an iron used on the top surface to the table portion 12. The thickness of the table portion is on the order of only one-half inch or so; the thickness may be greater or less than this, in practice. The modest dimensions of the table allow the table 10 to be stored in a relatively small and narrow area. An optional hook hingedly attached to the underside of the table and visible in FIG. 4 in its stored position 24 and its position for use 24', may be provided to allow for hanging the ironing table on a closet rod or other suspension point for storage.

Figure 2:
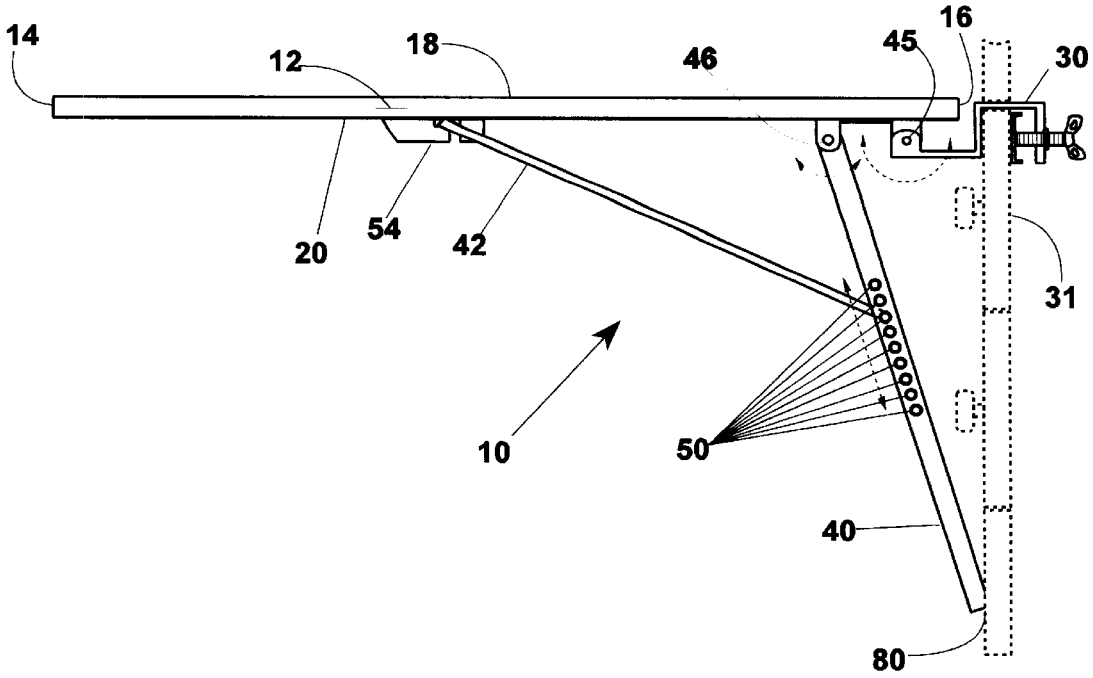
FIG. 2 is a side view of the ironing table of FIG. 1.

The means for attaching the ironing table to a substantially vertical support is best seen in FIG. 2. The attachment clamp 30, a screw-type clamp having flat surfaces to engage a substantially flat panel, is hingedly attached to the bottom surface 20 of the table portion 12 at a point 45 that allows it to pivot through an arc that is greater than 180 degrees. At one extreme of this arc, the clamp 30 lies against the bottom of the board as seen in FIG. 4. The clamp adapts the ironing table of this invention to be removably attached to any substantially vertical support panel 31. Such a panel may be a drawer front, a sink rim, and especially a chair back. Key to this invention is the clamping and hinged nature of this clamp, adapting the invention to be removably attached to such a substantially vertical panel.

Cooperating in the support of the ironing table is an adjustable stabilizing leg structure of two parts: a leg 40 and a brace 42.

The leg 40 is hingedly attached to the bottom surface 20 of the table portion 12 and pivots from a position flush against the bottom surface 20 of the board, as seen in FIG. 4, to a position in which it, in cooperation with said clamp means 30, provides support for the table portion 12 of the ironing table 10 as shown in the other Figs. The leg 40 comprises two leg elements 44 descending from a hinge point 46 and joined at their distal end. A plurality of holes 50 pass horizontally through each leg element 44 such that each hole in one leg element 44 is in axial alignment with an opposing hole on the other leg element. The leg may pivot through an angle that approaches 180 degrees. It should be understood that holes 50 may be provided in locations along the leg 40 other than those shown in the attached drawings, to accommodate more extreme angles.

The brace 42 has a pair of lateral extensions 52 that are used to removably engage a pair of the opposing holes 50 on the leg elements 44 to form a hinged connection between the brace 42 and the leg 40 near the mid point of the leg. The other end of the brace 42, the distal end thereof, removably engages and may be locked into a slotted fixture 54 on the bottom surface 20 of the table portion 12. Thus, a rigid triangular structure is formed by the table portion 12, the leg 40, and the brace 42. This structure is easily adjusted by selectively engaging the brace into various sets of holes in the leg, resulting in a means for selecting the angle of the leg relative to the table portion and the clamp. This selective adjustment adapts the ironing table of this invention to be mounted to substantially vertical panels of various angles.

With the brace 42 disengaged from the slotted fixture 54, the brace freely pivots on the leg and the leg 40 freely pivots on the bottom surface 12 of the table so that the brace 42 and the leg 40 fold flat against the bottom surface 12 of the table portion 12 for storage. When the table 10 is hanging by the optional hook 24, gravity keeps the leg 40 and brace 42 against the table bottom 12. Otherwise, a catch mechanism 60 may be provided. The type of catch mechanism 60 that could be used is also shown in FIG. 4 pivotably attached to the bottom surface 20 of the table portion 12 and pivoting to capture the leg 40. Such a catch could be used on the optional hook 24, also, as is shown at 60'.

Figure 3:
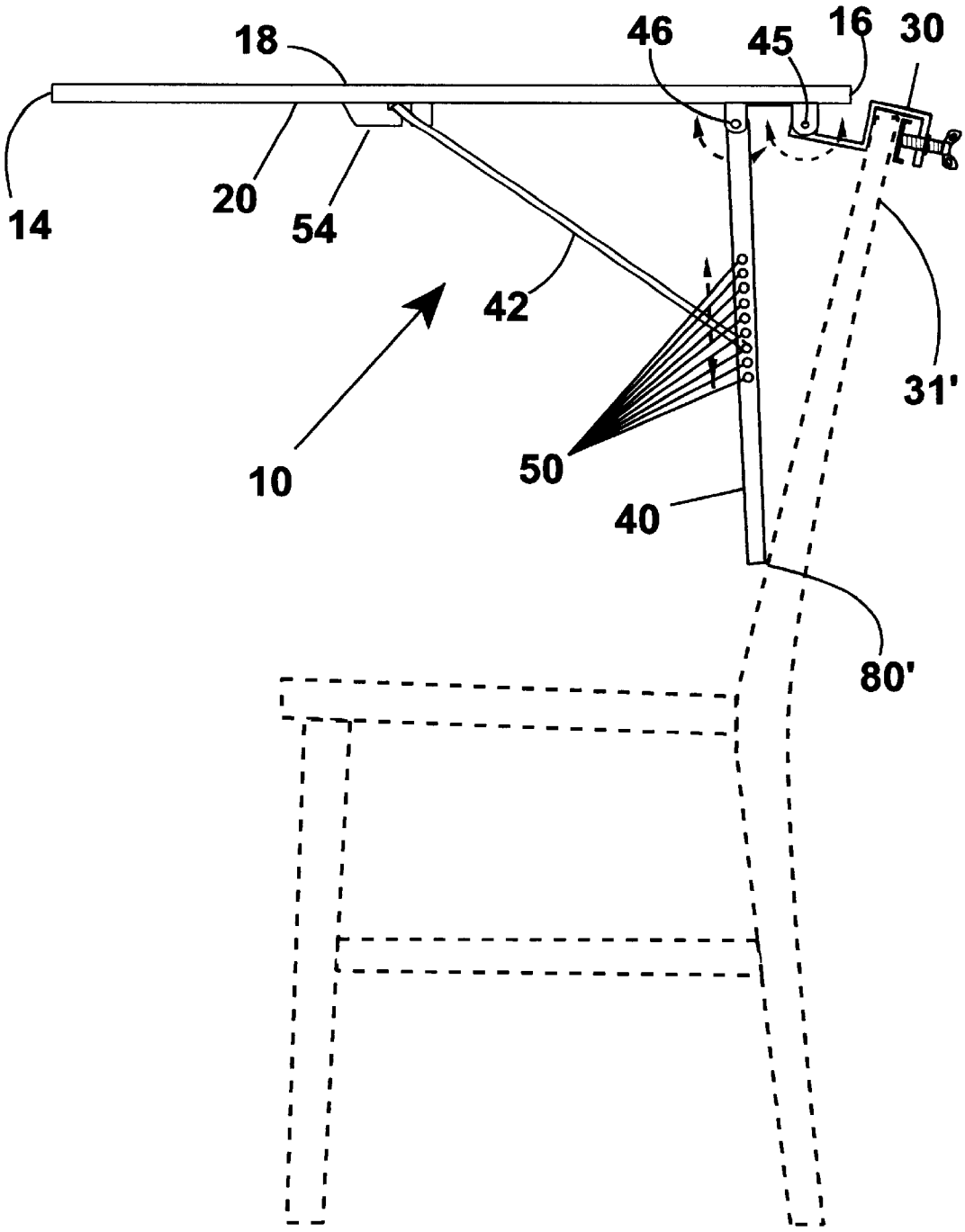
FIG. 3 is a side view of the ironing table of this invention as it may be mounted on the back of a chair.

As an example of the versatility of the invention, the ironing table 10 is shown mounted on the back of a straight-backed chair 70 in FIG. 3. It can be seen that the back 31' of the chair 70 would not be perfectly vertical; few such chairs have vertical backs. It is estimated that some chair backs may be at an angle of up to 45 degrees from the vertical; the invention may be adapted to accommodate such a wide variation from the vertical. It is more likely that the angle is about 20 degrees from the vertical. The leg adjustment allows leveling or near-leveling of the top surface 18 for a rather broad range of angles of the support panel.

The clamp portion 30 of this invention is adapted to be secured firmly to a substantially vertical panel 31, 31'. This securement fixes, relative to the panel, the location of the hinged attachment at 46 of the ironing table and provides all of the vertical support and lateral support for the table and the activities performed thereon, albeit allowing pivoting movement around the axis of the hinge at 46. The adjustable leg portion 40 needs only to provide support to prevent such pivoting movement around the axis of the hinge at 46 that might otherwise result from the effect of gravity on the ironing table and the effect of activities performed thereon. Thus the leg 40, the attachment of which to said table is made rigid by the associated adjustable brace 42, is adapted merely to contact at least one single point on a surface 80, 80' that is stable with respect to the aforesaid panel and is at a distance from the pivot axis of the hinge at 46, providing a lever arm, thereby to provide the required rotational support. Note well that providing this rotational support does not require engagement with the floor or any surface that is necessarily horizontal because all of the vertical support required is provided by the clamp mechanism. Nor does the leg require any bracing from any source other than that provided by the brace 42 that is a part of the ironing table of this invention.

Whereas the present invention has been described in terms of specific embodiments, certain modifications and equivalents will be apparent to those skilled in the art and are intended to be included within the scope of the present invention, which scope is limited only by the appended claims.

I claim:

1. An ironing table comprising a flat, thin, planar table portion having a forward end, an opposite substantially straight rearward end, and a midpoint, an upper surface, and an opposite lower surface, and having attached to said lower surface:

a. a screw clamp means pivotably attached along an axis that is proximal to said rearward end and substantially parallel thereto, said clamp adapting said ironing table for attachment to a panel that is substantially vertical but may vary from the vertical by up to 90 degrees;

b. a leg pivotably attached along an axis that is substantially parallel to said rearward end, thereby to pivot through an angle of nearly 180 degrees to contact a substantially vertical fixed surface;

c. a brace removably attached near said midpoint and pivotably attached to said leg at any of a plurality of selectable locations along the length of said leg, thereby to selectably fix the angle of said leg relative to said lower surface;

wherein said screw clamp means, said leg, and said brace in combination fix the angle of the planar table portion in a desired position relative to said substantially vertical panel and said fixed surface.

2. An ironing table comprising a flat, thin, planar table portion having a forward end, an opposite substantially straight rearward end, and a midpoint, an upper surface, and an opposite lower surface, and having attached to said lower surface:

a. a screw clamp means pivotably attached along an axis that is proximal to said rearward end and substantially parallel thereto, said clamp adapting said ironing table for attachment to a panel that is substantially vertical but may vary from the vertical by up to 30 degrees;

b. a leg pivotably attached along an axis that is substantially parallel to said rearward end, thereby to pivot through an angle of nearly 180 degrees to contact a substantially vertical fixed surface;

c. a brace removably attached near said midpoint and pivotably attached to said leg at any of a plurality of selectable locations along the length of said leg, thereby to selectably fix the angle of said leg relative to said lower surface;

wherein said screw clamp means, said leg, and said brace in combination fix the angle of the planar table portion in a desired position relative to said substantially vertical panel and said fixed surface.

3. The ironing table described in claims 1 or 2 and adapted for storage by hanging, as on a closet pole, said ironing table so adapted by having a hook element also attached to said lower surface pivotably attached along an axis that is substantially parallel to said rearward end, thereby to pivot through an angle of approximately 180 degrees from a storage position against said lower surface to a use position wherein a hook-shaped portion extends beyond said rearward end, thereby enabling said hook-shaped portion for use in hanging said ironing table.

4. An ironing table comprising a flat, thin, planar table portion having a forward end, an opposite substantially straight rearward end, and a midpoint, an upper surface, and an opposite lower surface, and having attached to said lower surface:

a. a screw clamp means pivotably attached along an axis that is proximal to said rearward end and substantially parallel thereto, said clamp adapting said ironing table for attachment to a panel that is substantially vertical;

b. a leg pivotably attached along an axis that is substantially parallel to said rearward end, thereby to pivot through an angle of nearly 180 degrees to contact a substantially vertical fixed surface;

wherein said screw clamp means in combination with said leg provides support for said ironing table while in use.

5. The ironing table described in claim 4 and adapted for storage by hanging, as on a closet pole, said ironing table so adapted by having a hook element also attached to said lower surface pivotably attached along an axis that is substantially parallel to said rearward end, thereby to pivot through an angle of approximately 180 degrees from a storage position against said lower surface to a use position wherein a hook-shaped portion extends beyond said rearward end, thereby enabling said hook-shaped portion for use in hanging said ironing table.

* * * * *